US006367453B1

(12) United States Patent
Igashira et al.

(10) Patent No.: US 6,367,453 B1
(45) Date of Patent: Apr. 9, 2002

(54) FUEL INJECTION VALVE

(75) Inventors: Toshihiko Igashira, Toyokawa; Shuichi Matsumoto, Kariya; Yoshihiro Narahara, Susono; Masatoshi Kuroyanagi; Toshio Kondo, both of Kariya, all of (JP)

(73) Assignee: Denso Corporation, Kariya (JP)

( * ) Notice: Subject to any disclaimer, the term of this patent is extended or adjusted under 35 U.S.C. 154(b) by 0 days.

(21) Appl. No.: 09/703,714

(22) Filed: Nov. 2, 2000

(30) Foreign Application Priority Data

Nov. 10, 1999 (JP) ..... 11-319010
Apr. 13, 2000 (JP) ..... 2000-112172
Jul. 31, 2000 (JP) ..... 2000-230299

(51) Int. Cl.[7] ..... F02M 37/04
(52) U.S. Cl. ..... 123/467; 123/498; 239/96
(58) Field of Search ..... 123/506, 467, 123/498; 239/88–96, 585.1

(56) References Cited

U.S. PATENT DOCUMENTS 4,997,132 A * 3/1991 Yamamoto ..... 239/533.8
5,819,710 A 10/1998 Huber ..... 123/498

FOREIGN PATENT DOCUMENTS

EP 0 921 301 6/1999
EP 0 976 924 2/2000

* cited by examiner

*Primary Examiner*—Thomas N. Moulis
(74) *Attorney, Agent, or Firm*—Nixon & Vanderhye P.C.

(57) ABSTRACT

In a fuel infection valve, a valve chamber of a three ways valve is selectively communicated to drain and high pressure conduits and also communicated, via a main orifice, to a control chamber for controlling valve opening and closing operations of a nozzle needle. The control chamber may be communicated via the main orifice and the valve chamber to the drain conduit or the high pressure conduit, when a valve body is driven by a piezo actuator to open or close the drain conduit and close or open the high pressure conduit. The control chamber is always communicated via a sub orifice to the high pressure conduit without bypassing the three ways valve. Accordingly, hydraulic pressure in the control chamber is slowly decreased at a valve opening time and is rapidly increased at a valve closing time so that a lift characteristic of the nozzle needle is improved.

10 Claims, 8 Drawing Sheets

PIEZO VOLTAGE (V)

VALVE BODY LIFT (mm)

CONTROL CHAMBER PRESSURE (MPa)
dPd
dt
dPu
dt

NOZZLE LIFT (mm)

INJECTION RATE (mm³/ms)
dt
dqu
dt
dqd
a
b

FUEL INJECTION VALVE

CROSS REFERENCE TO RELATED APPLICATION

This application is based upon and claims the benefit of priority of Japanese Patent Applications No. H.11-319010 filed on Nov. 10,1999, No. 2000-112172 filed on Apr. 13, 2000 and No. 2000-230299 filed on Jul. 31, 2000, the contents of which are incorporated herein by reference.

BACKGROUND OF THE INVENTION

1. Field of the Invention

The present invention relates to a fuel injection valve applicable to common rail fuel injection systems for internal combustion engines, in particular, to the construction of the fuel injection valve.

2. Description of Related Art

As a fuel supply system for internal combustion engines, a common rail fuel injection system, in which fuel pressurized by a high pressure supply pump is accumulated in a common rail and injected to each engine cylinder at a given timing, is well known. The common rail fuel injection system has merits that injection timing and injection amount are accurately controlled. As a fuel injection valve of the common rail fuel injection system, as disclosed in U.S. Pat. No. 5,819,710, known is a fuel injection valve in which a valve opening and closing force for moving a nozzle needle to open and close an injection hole is given by hydraulic pressure in a control chamber. A three ways valve controls hydraulic pressure in the control chamber. The three ways valve has a valve body to be driven by a piezoelectric actuator. The control chamber is communicated selectively to a low pressure passage or a high pressure passage according to a position where the valve body is seated. When the valve body is driven so as to open the low pressure passage and close the high pressure passage, the control chamber is communicated to the low pressure chamber so that hydraulic pressure in the control chamber may be decreased and the nozzle needle may be moved to open the injection hole through which fuel is injected.

The conventional injection valve mentioned above is provided with an orifice between the three ways valve and the control chambers. The orifice serves to adjust a valve opening speed of the nozzle needle and a valve closing speed thereof. Since, at both of a valve opening time and a valve closing time, fuel passes through the same orifice, decreasing and increasing speeds of hydraulic pressure in the control chamber can't be independently controlled. It is preferable, as an injection characteristic, that the decreasing speed of hydraulic pressure in the control chamber is relatively slow so as to move slowly the nozzle needle at the valve opening time and the increasing speed of hydraulic pressure is relatively fast so as to move rapidly the nozzle needle at the valve closing time. However, in the conventional fuel injection valve, as a diameter of the orifice becomes larger, both of increasing and decreasing speeds of hydraulic pressure become higher. On the contrary, a diameter of the orifice becomes smaller, both of increasing and decreasing speeds of hydraulic pressure become lower. Therefore, the fuel injection valve having slow valve opening and rapid valve closing characteristics is desired.

SUMMARY OF THE INVENTION

An object of the present invention is to provide a fuel injection device in which a pressure decreasing speed in a control chamber is relatively low and a pressure increasing speed in the control chamber pressure is relatively high so that the nozzle needle may be moved slowly at a valve opening time and rapidly at a valve closing time.

To achieve the object, the fuel injection valve is composed of a nozzle needle for opening and closing an injection hole, a control chamber for urging the nozzle needle in a direction of closing the injection hole when hydraulic pressure is supplied thereto, low pressure and high pressure conduits, a three ways valve having a valve chamber, a valve body and first, second and third ports, a first conduit communicating the first port to the low pressure conduit, a second conduit communicating the second port to the high pressure conduit, a third conduit communicating the third port to the control chamber and a fourth conduit communicating the control chamber to the high pressure conduit. The third and fourth Conduits are provided with a main orifice and a sub orifice, respectively.

With the construction mentioned above, the control chamber may be communicated to the low pressure conduit via the third conduit, the valve chamber and the first conduit, when the valve body opens the first port and closes the second port, and be communicated to the high pressure conduit via the third conduit, the valve chamber and the second conduit, when the valve body closes the first port and opens the second port.

Further, at the valve opening time, when the valve body is driven to open the first port and the pressure of the valve chamber is reduced, pressure in the control chamber is reduced. On the other hand, high pressure is still applied to the control chamber since the control chamber is always communicated to the high pressure passage via the fourth conduit with the sub orifice. Therefore, a pressure decreasing speed in the control chamber is relatively low and the movement of the nozzle needle for opening the injection hole becomes relatively slow.

Then, at the valve closing time, when the valve body is driven to close the first port and pressure of the valve chamber is increased, pressure in the control chamber is increased. At the same time, high pressure is directly applied to the control chamber from the high pressure conduit via the fourth conduit with the sub orifice. Therefore, a pressure increasing speed in the control chamber is relatively high and the movement of the nozzle needle for closing the injection hole becomes relatively fast.

When a diameter of the sub orifice is small relatively to a diameter of the main orifice, pressure in the control chamber can't be increased with a sufficiently high speed. On the other hand, when the diameter of the sub orifice is large relatively to that of the main orifice, a minimum valve opening pressure of the nozzle needle becomes too high. Accordingly, it is preferable to secure both of sharp valve closing characteristic and low minimum valve opening pressure that a diameter ratio of the sub orifice to the main orifice (a diameter of the sub orifice/ a diameter of the main orifice) falls within a range from 0.5 to 1.0 when the minimum valve opening pressure of the nozzle needle is set to not larger than 20 Mpa.

Further, when the minimum valve opening pressure of the nozzle needle is set to not larger than 30 Mpa, the diameter ratio of the sub orifice to the main orifice may fall within a range from 0.6 to 1.2 to realize the sharp valve closing characteristic and the available low minimum valve opening pressure.

Preferably, the fuel injection valve has a spring chamber communicated to the high pressure conduit. A spring for urging the nozzle needle in a valve closing direction is housed in the spring chamber. A head of the nozzle needle is also housed in the spring chamber and is provided with the control chamber and the fourth conduit with the sub orifice connecting the spring chamber and the control chamber. The third conduit with the main orifice extends from the control chamber to the second port through space of the spring chamber but without communicating to the spring chamber.

According to the construction mentioned above, as the control chamber is formed inside the head of the nozzle needle, a volume of the control chamber is relatively small so that good controllability may be secured. Further, the third conduit may be constituted and easily manufactured by, for example, a pipe member and the main orifice also may be easily manufactured. Furthermore, as the fourth conduit with the sub orifice is formed in the head and their constructions are simple, manufacturing of the same is very easy.

It is preferable to have a nozzle lift stopper with which an upper end of the nozzle needle may come in contact and by which a movement of the nozzle needle may be stopped for restricting a lift amount thereof. Unless the fuel injection valve is provided with the stopper, the lift amount becomes unnecessarily large at the valve closing time so that a moving distance of the nozzle needle becomes longer, resulting in taking a longer time for closing the injection hole. The fuel injection valve having the stopper mentioned above has a good valve closing response characteristic.

Preferably; the third conduit having the main orifice is opened to a surface of the stopper portion facing the control chamber so that the nozzle needle may close the third conduit when the upper end surface of the nozzle needle is in contact with the stopper. With the construction mentioned above, at the valve closing time, high pressure of fuel flowing into the third conduit via the valve chamber is applied to the upper end surface of the nozzle needle. Accordingly, the nozzle needle may start the valve closing operation immediately without spending a time during which high pressure fuel enters into a clearance between the upper end surface of the nozzle needle and the stopper surface from an outer periphery thereof.

The main orifice is, preferably, formed in the third conduit at an opening end to the control chamber. To improve a valve closing response characteristic, it is better that an area where the nozzle needle and the stopper are in contact with each other is smaller. As the main orifice is formed at the opening end of the control chamber, an area of the stopper may be smaller so that the area where the nozzle needle and the stopper are in contact with each other may become smaller.

At least the second and fourth conduits may be formed in a block shaped conduit-forming member disposed between the valve chamber and the control chamber whose one end surface constitutes a part of a wall of the valve chamber and whose another end surface constitutes a part of a wall of the control chamber. The conduit-forming member is provided with the high pressure conduit penetrating from the one end surface thereof to the another end surface thereof, a branch conduit extending from the high pressure conduit, the second conduit extending from the branch conduit to the valve chamber, and the fourth conduit having the sub orifice extending from the branch conduit to the control chamber. In this case, respective connections of the branch conduit to the high pressure conduit, to the second conduit and to the fourth conduit are made, preferably, at an angle more than a near right angle so that the respective connections of the branch conduit may be prevented from being harmed by high pressure fuel. Further, as the conduit-forming member is a single element, the fuel injection valve may be composed of a less number of parts and component at a lower cost.

The branch conduit may be constituted by a hole extending horizontally from the high pressure conduit toward an inside of the conduit-forming member or a groove extending from the high pressure conduit on at least one of end surfaces of the conduit-forming member.

The groove may be provided on each of opposite end surfaces of the conduit-forming member. The second conduit is connected to one of the grooves and the fourth conduit having the sub orifice is connected to the other of the grooves. In this case, if the grooves extend in opposite directions from the high pressure conduit so as to put the second and fourth conduits therebetween, the second and fourth conduits may be easily manufactured without interfering with each other.

BRIEF DESCRIPTION OF THE DRAWING

Other features and advantages of the present invention will be appreciated, as well as methods of operation and the function of the related parts, from a study of the following detailed description, the appended claims, and the drawings, all of which form a part of this application. In the drawings:

DETAILED DESCRIPTION OF THE PREFERRED EMBODIMENTS

First Embodiment

Figure 1:
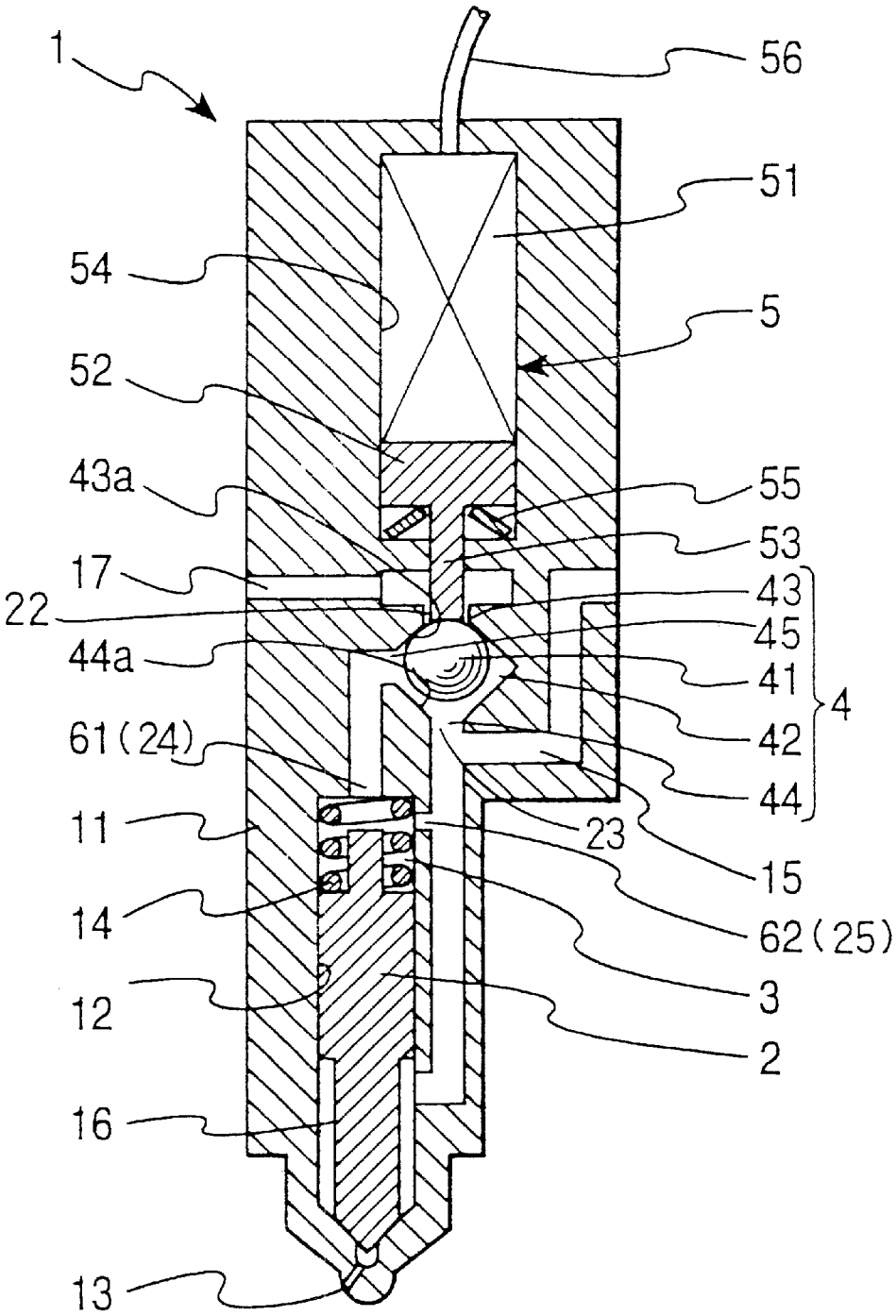
FIG. 1 is a cross sectional view of a fuel injection valve according to a first embodiment of the present invention.

FIG. 1 shows an outline structure of a fuel injection valve 1 according to a first embodiment of the present invention. The fuel injection valve 1 is used, typically in a common rail fuel injection system, for directly injecting high pressure fuel accumulated in the common rail to each cylinder of the engine. A valve housing 11 is provided at a lower portion thereof with a cylinder 12 in which a nozzle needle 2 is slidably housed. In FIG. 1, a leading portion of the nozzle needle 2 comes in contact with and closes an injection hole 13 provided at a leading end of the valve housing 11.

The cylinder 12 is provided at an upper part thereof with a control chamber 3 for giving hydraulic pressure to the nozzle needle 2 in a direction of closing the injection hole 13 (in a valve closing direction). The nozzle needle 2 moves in up and down directions in the cylinder 12 according to increased and decreased hydraulic pressure in the control chamber 3. A spring 14 for urging the nozzle needle 2 in the valve closing direction is arranged in the control chamber 3. The nozzle needle 2 is provided at a lower part thereof with a smaller diameter portion whose diameter is a little bit smaller that that of the other portion thereof. A ring shaped space is formed between the small diameter portion and the cylinder 12. The ring shaped space is communicated to a high pressure passage 15 and constitutes a fuel accumulating space 1.

The valve housing 11 is provided at a middle part thereof with a three ways valve 4 for increasing and decreasing hydraulic pressure in the control chamber 3. The three ways valve 4 is composed of a valve chamber 42 and a ball shaped valve body 41. The valve chamber 42 is provided at an upper end thereof with a low pressure port 43 (first port) as a drain port, at a lower end with a high pressure port 44 (second port) and at a side face with a communication port 45 (third port). The valve body 41 may be moved to open and close selectively the low and high pressure ports 43 and 44. The low pressure port 43 is communicated via a conduit 22 (first conduit) and a low pressure conduit 17 or a drain passage to a low pressure passage in the system (not shown) and the high pressure port 44 is communicated via a conduit 23 (second conduit) and a high pressure conduit 15 to an outside high pressure fuel source or passage (for example, to the common rail).

The valve body 41 is driven by a piezoelectric actuator 5 housed in an upper end of the valve housing 11. The piezoelectric actuator 5 is provided with a piezo element 51 deforming so as to expand or contract according to an application or non-application of an electric voltage, a piezo piston 52 in contact with an end surface of the piezo element 51 and slidably movable in the cylinder 54, and a rod 53 extending downwardly from a center of an end surface of the piezo piston 52 so as to pass through the high pressure port 44 and to come in contact with the valve body 41. When the piezo piston 52 is moved downwardly or upwardly by the expansion or contraction of the piezo element 51, the valve body 41 comes in contact with a taper shaped seat surface 44*a* of the high pressure port 44 or a taper shaped seat surface 43*a* of the low pressure port 43 so that the high and low pressure ports may be selectively closed.

A plate spring 55 is arranged in the cylinder 54 below the piezo piston 52 and biases the piezo element 51 upwardly (in contracting direction) via the piezo piston 52. A lead wire 56 is connected to an upper surface of the piezo element 51 for applying the voltage thereto.

A conduit 24 (third conduit) constituting a main orifice 61 is connected between an upper end of the control chamber 3 and the valve chamber 42 via the communication port 45 so that the control chamber 3 is always communicated to the valve chamber 42. That is, the control chamber 3 is communicated to the low pressure conduit 17 and the high pressure conduit 15 selectively according to positions where the valve body 41 is seated so that hydraulic pressure acting on the nozzle needle 2 may be increased and decreased.

Further, a conduit 25 (fourth conduit) constituting a sub orifice 62 is connected between a side face of the control chamber 3 and the high pressure conduit 15 so that the control chamber 3 is always communicated to the high pressure conduit 15 and high pressure fuel from the high pressure conduit 15 is continuously applied to the control chamber 3.

The sub orifice 62 works to attain a relatively low decreasing speed of hydraulic pressure in the control chamber 3 that causes the nozzle needle 2 to slowly open the injection hole 13. To optimize an injection characteristic, a ratio of a diameter of the sub orifice 62 to that of the main orifice 61 becomes important, with respect to which is described later.

An operation of the fuel injection valve mentioned above is described with reference to a time chart shown in FIGS. 2A to 2E. FIG. 1 shows a state in which the valve body 41 of the three ways valve 4 is in contact with the seat surface 43*a* so that the low pressure port 43 is closed and the high pressure port 44 is opened. The control chamber 3 is communicated to the high pressure conduit 15 through a rout of the main orifice 61 and the valve chamber 42 and through an another rout of the sub orifice 62. The nozzle needle 2 closes the injection hole 13 upon receiving hydraulic pressure in the control chamber 3 and the biasing force of the spring 14.

Next, at the valve opening time of the nozzle needle 2, the electric voltage is applied via the lead wire 56 to the piezo element 51 of the piezoelectric actuator 5 (refer to a point a in FIGS. 2A to 2E) so that the piezo element 51 expands against a biasing force of the plate spring 55. Therefore, the rod 53 of the piezo piston 52 pushes downwardly the valve body 41, which is in contact with the seat surface 43*a* of the low pressure port 43, for opening the low pressure port 43 and, then, comes in contact with the seat surface 44*a* of the high pressure port 44 for closing the high pressure port 44. Accordingly, the control chamber 3 is communicated to the low pressure conduit 17 and fuel in the control chamber 3 flows to the low pressure conduit 17 via the main orifice 61 and the valve chamber 42 so that hydraulic pressure in the control chamber is reduced.

According to the present invention, on the other hand, since the control chamber 3 is always communicated to the high pressure conduit 15 via the sub orifice 62 and high pressure fuel is flown into the control chamber 3, pressure in the control chamber 3 is slowly decreased. When hydraulic pressure in the fuel accumulating space 16, which pushes upwardly the nozzle needle 2, exceeds a sum of hydraulic pressure in the control chamber 3 and a biasing force of the spring 14, both of which pushes downwardly the nozzle needle 2, the nozzle needle 2 starts lifting and lifting speed of the nozzle needle 2 becomes slow so that an initial stage injection rate may be low.

Next, at the valve closing time of the nozzle needle 2, the electric voltage applied to the piezo element 51 of the piezo actuator 5 is lowered (a point b in FIGS. 2A to 2E). Accordingly, the piezo element 51 contracts so that the piezo piston 52 may be upwardly moved by a biasing force of the plate spring 55 and the valve body may be moved upwardly by hydraulic pressure applied upwardly to the high pressure port 44. As a result, the valve body 41 leaves the seat surface 44*a* to open the high pressure port 44 and, then, comes in contact with the seat surface 43*a* to close the low pressure port 43. Therefore, the control chamber 3 is communicated via the main orifice 61, communication port 45, the valve chamber 42 and the high pressure port 44 to the high pressure conduit 15 so that hydraulic pressure in the control chamber 3 may increase.

Figures 2A, 2B, 2C, 2D, 2E:
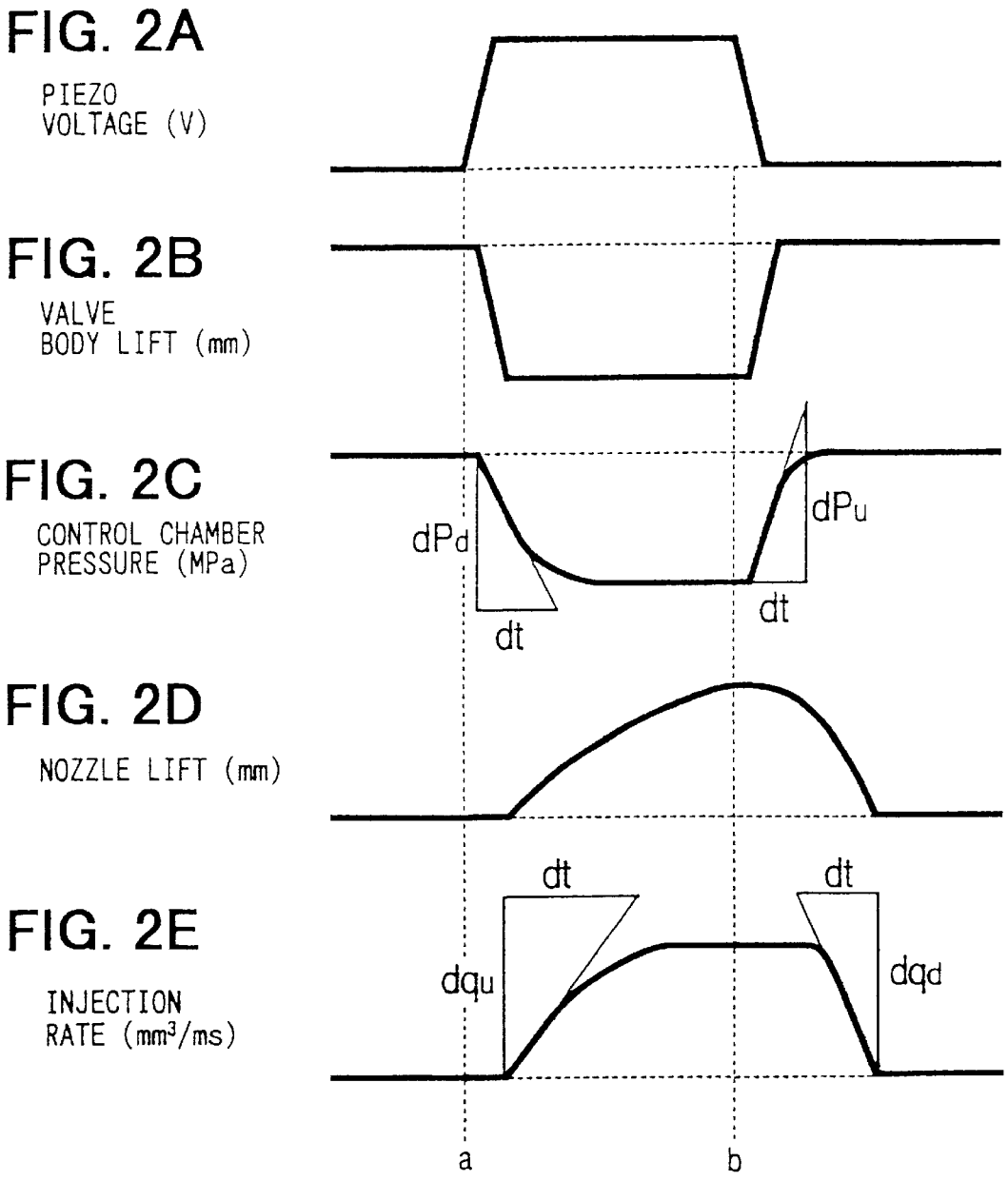
FIGS. 2A to 2E are time charts for explaining an operation of the fuel injection valve of FIG. 1.

As the control chamber 3 is always communicated via the sub orifice 62 to the high pressure conduit 15, high pressure fuel is supplied through both the main and sub orifices 61 and 62. Accordingly, as shown in FIG. 2C, hydraulic pressure in the control chamber 3 is sharply increased. And, when the sum of the hydraulic pressure in the control chamber 3 and the biasing force of the spring 14 exceeds the hydraulic pressure in the fuel accumulating chamber 16, the nozzle needle 2 moves downwardly at a rapid speed to close the injection hole 13 rapidly and to stop fuel injection, as shown in FIG. 2D.

Figure 3A:
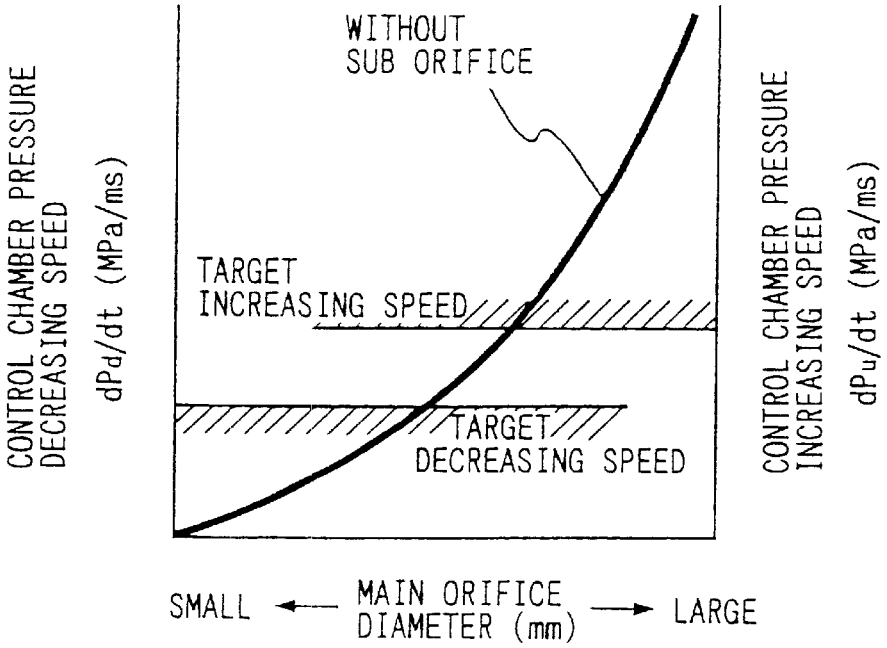
FIG. 3A is a chart showing a relationship between a diameter of a main orifice and hydraulic pressure decreasing or increasing speed in a control chamber in case a sub orifice is not provided.
Figure 3B:
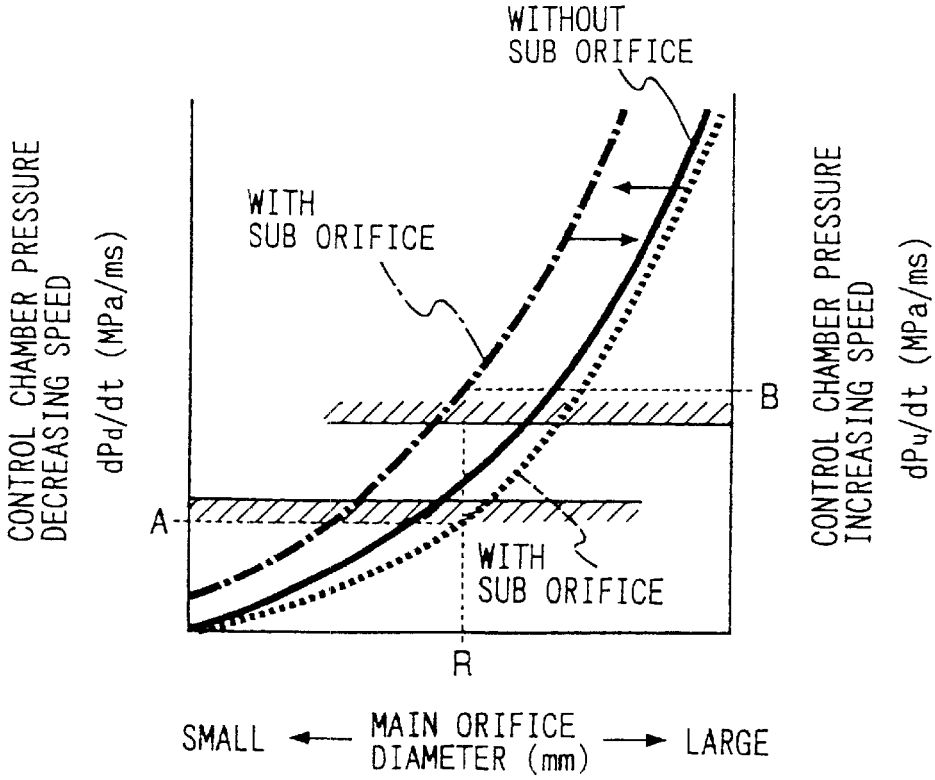
FIG. 3B is a chart showing a relationship between a diameter of a main orifice and hydraulic pressure decreasing or increasing speed in a control chamber in case a sub orifice is provided.

FIGS. 3A and 3B show an effect of the sub orifice 62 at the valve opening and closing times. In a case that only the main orifice 61 is provided and the sub orifice 62 is not provided, a relationship between a diameter of the main orifice 61 and the decreasing speed or increasing speed of hydraulic pressure in the control chamber 3 is shown in FIG. 3A. In this case, the hydraulic pressure decreasing speed and the hydraulic pressure increasing speed are identical. Therefore, if the diameter of the main orifice 61 is set to a smaller value so as to lower a valve opening speed, that is, the decreasing speed of the hydraulic pressure in the control chamber 3 to a value below a target value of pressure decreasing speed, a valve closing speed, that is, the increasing speed of the hydraulic pressure in the control chamber 3 never exceeds a target value of pressure increasing speed. On the contrary, if the diameter of the main orifice 61 is set to a larger value to increase the increasing speed, the decreasing speed does not meet the target value.

In a case that the sub orifice 62 is employed, a hydraulic pressure decreasing speed curve and a hydraulic pressure increasing speed curve are shown by a dot line and a dot-slash line in FIG. 3B, respectively. The hydraulic pressure decreasing speed curve is shifted to the right and the hydraulic pressure increasing speed curve is shifted to the left, compared to the characteristic curve without the sub orifice 62. As shown in FIG. 3B, the hydraulic pressure decreasing speed is slower and the hydraulic pressure increasing speed is faster, compared to the speed without the sub orifice 62. For example, when the diameter of the main orifice 61 is R, the hydraulic pressure decreasing speed is A and the hydraulic pressure increasing speed is B, both of which fall within and satisfy the respective target values.

Figure 4A:
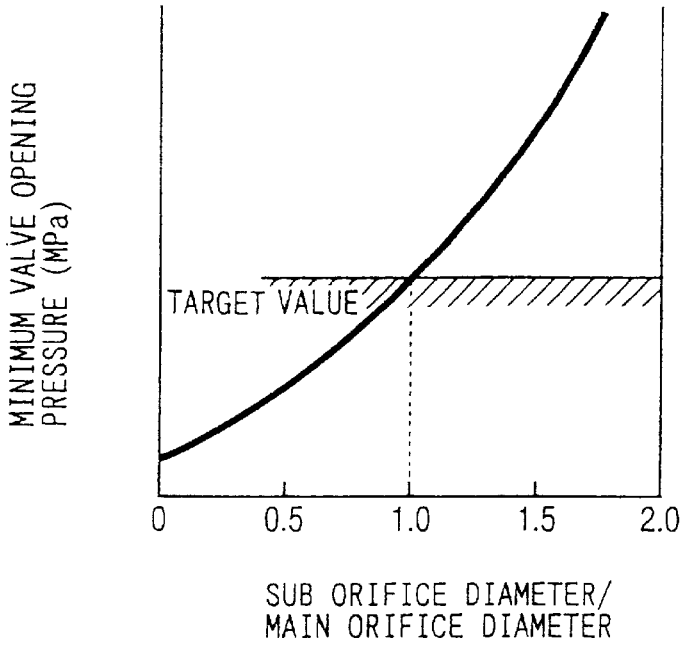
FIG. 4A is a chart showing a diameter ratio of the sub orifice to the main orifice and a minimum valve opening pressure as a first example.

Next, the ratio of the diameter of the sub orifice 62 to the diameter of the main orifice 61 is described with reference to FIGS. 4A and 4B. As shown in FIG. 4A, as the diameter of the sub orifice 62 relative to the diameter of the main orifice 61 becomes larger, a minimum valve opening pressure becomes larger so that higher pressure is required to lift the nozzle needle 2. When the minimum valve opening pressure is set to not larger than 20 Mpa as a target value in the general fuel injection valve, it is preferable that the ratio of the diameter of the sub orifice 62 to the diameter of the main orifice 61 is below 1.0.

Figure 4B:
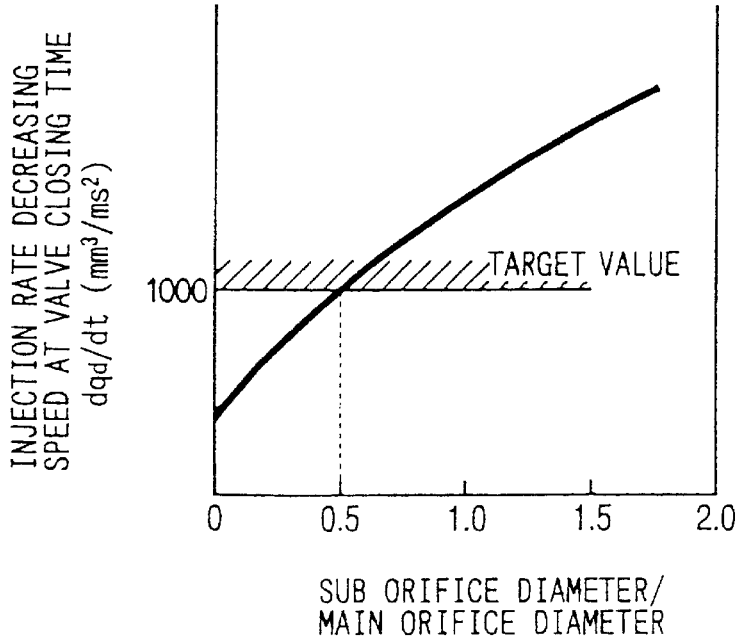
FIG. 4B is a chart showing a diameter ratio of the sub orifice to the main orifice and an injection rate decreasing speed at a valve opening time as a first example.

Further, as shown in FIG. 4B, as the diameter of the sub orifice 62 relative to the diameter of the main orifice 61 becomes smaller, an injection rate decreasing speed at the valve closing time becomes smaller so that the rapid valve closing operation may not be achieved. To meet a target value (for example, 1000 $mm^3/m\ S^2$) of the injection rate decreasing speed at the valve closing time for securing a desired valve closing speed, it is preferable that the ratio of the diameter of the sub orifice 62 to the diameter of the main orifice 61 is not less than 0.5.

Figure 5A:
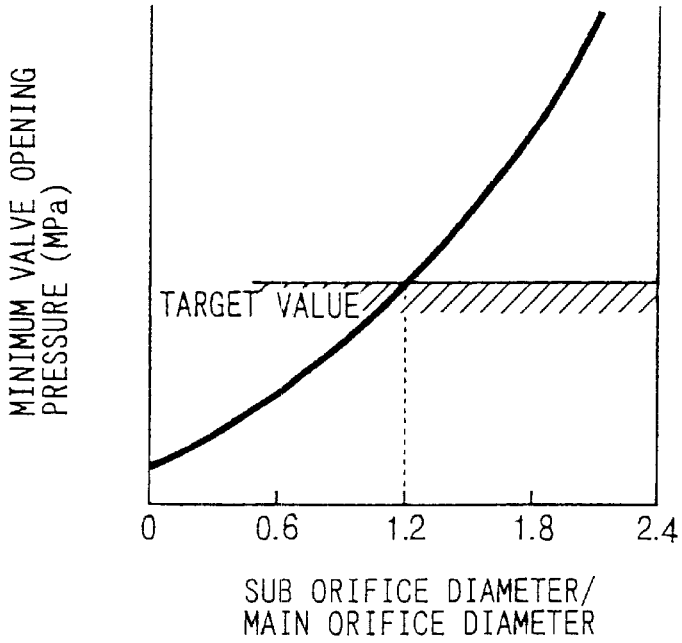
FIG. 5A is a chart showing a diameter ratio of the sub orifice to the main orifice and a minimum valve opening pressure as a second example.
Figure 5B:
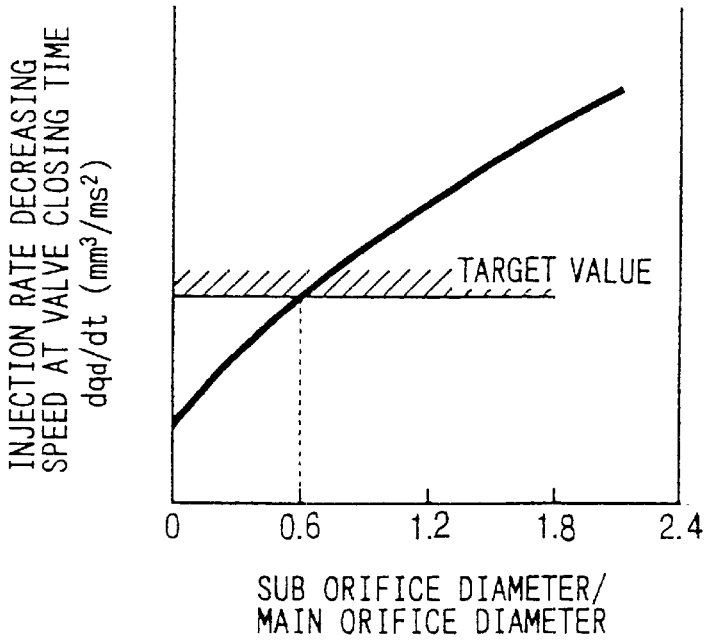
FIG. 5B is a chart showing a diameter ratio of the sub orifice to the main orifice and an injection rate decreasing speed at a valve opening time as a second example.

Moreover, as shown in FIG. 5A illustrating an another example, when the minimum valve opening pressure is set to not larger than 30 Mpa as a target value, it is preferable that the ratio of the diameter of the sub orifice 62 to the diameter of the main orifice 61 is below 1.2. Further, as shown in FIG. 5B, as the diameter of the sub orifice 62 relative to the diameter of the main orifice 61 becomes smaller, an injection rate decreasing speed at the valve closing time becomes smaller so that the rapid valve closing may not be achieved. To meet a target value (for example, 1000 $mm^3/m\ S^2$) of the injection rate decreasing speed at the valve closing time for securing a desired valve closing speed, it is preferable that the ratio of the diameter of the sub orifice 62 to the diameter of the main orifice 61 is not less than 0.6.

Second Embodiment

Figure 6:
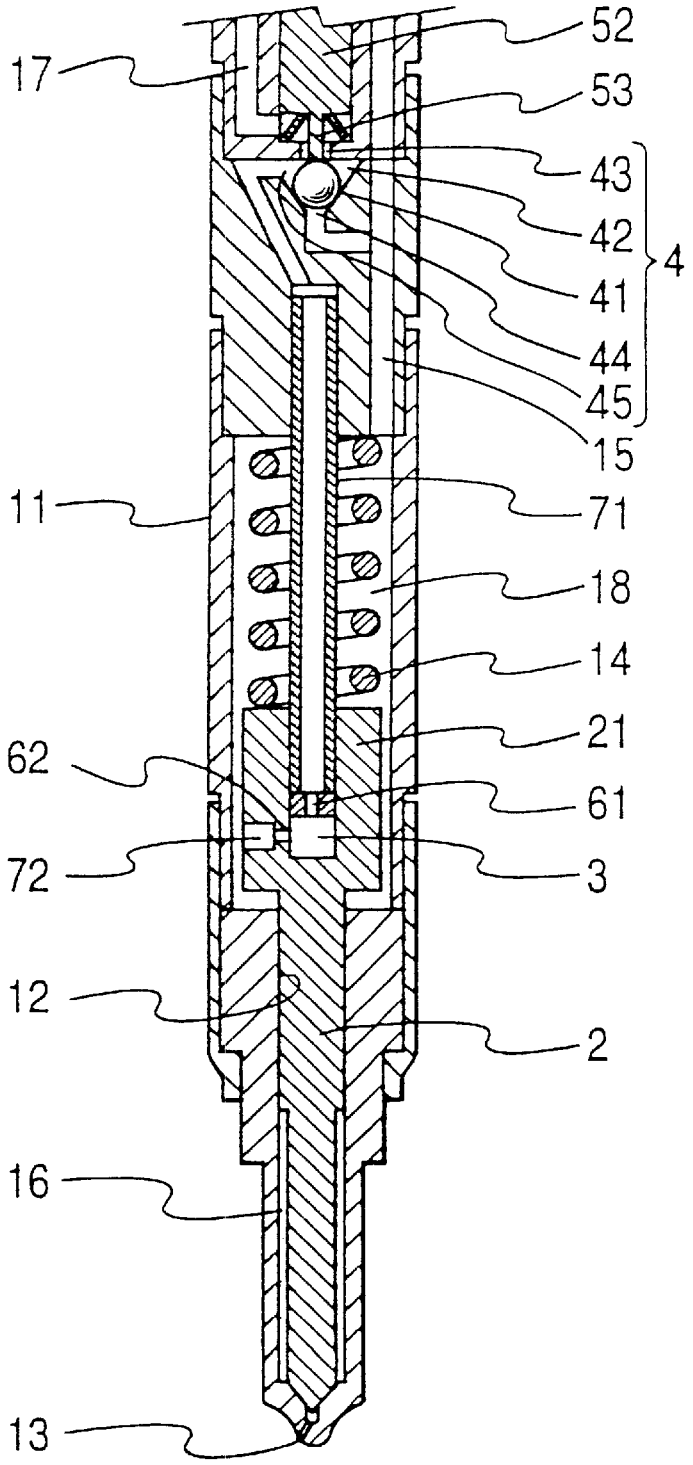
FIG. 6 is a cross sectional part view of a fuel injection valve according to a second embodiment of the present invention.

FIG. 6 shows a second embodiment of the present invention. Though the control chamber 3 provided above the nozzle needle 2 works commonly as a spring chamber for housing the spring 14 according to the first embodiment, the control chamber 3 is provided inside the nozzle needle 2 separately from a spring chamber 18 according to the second embodiment. That is, the spring chamber 18, whose diameter is larger than that of the cylinder 12, is provided in the valve housing 11 above the cylinder 12 where the nozzle needle slidably moves. A larger diameter head portion 21 of the nozzle needle 2 is housed in the spring chamber 18. The control chamber 3, which has a smaller volume, is provided in the head portion 21 of the nozzle needle 2. The spring chamber 18 is provided above the head portion 21 with a spring 14 that biases downwardly the nozzle needle 2. An upper end of the spring chamber 18 is connected to the high pressure conduit 15 to introduce high pressure fuel to the spring chamber 18 without by passing the three ways valve 4.

A communication pipe 71 extends upwardly and coaxially with the nozzle needle 2 for communicating the control chamber 3 and the valve chamber 42 of the three ways valve 4. An end of the communication pipe 71 is connected to the communication port 45 opened to a side face of the valve chamber 42. The other end of the communication pipe 71 is connected via the main orifice 61 provided in the head portion 21 to an upper end of the control chamber 3. A diameter of the main orifice 61, which is made of a ring shaped member, is smaller than an inner diameter of the communication pipe 71. An inside conduit of the communication pipe 71 and the main orifice 61 constitute the third conduit for communicating the valve chamber 42 to the control chamber 3.

The head portion 21 is provided with the sub orifice 62 opened to a side face of the control chamber 3 and a conduit 72 whose end is connected to the sub orifice 62 and whose another end is opened to the spring chamber 18.

Accordingly, the spring chamber 18, where high pressure fuel is introduced from the high pressure conduit 15 and constitute a part of the high pressure conduit, is always communicated via the conduit 72 and the sub orifice 62 to the control chamber 3. The conduit 72 and the sub orifice 62 constitute the fourth conduit for communicating the control chamber 3 and the high pressure conduit 15.

The spring chamber 18 is communicated via a clearance between an inside wall of the cylinder 12 and a sliding portion of the nozzle needle 2 to the fuel accumulating space 16. Therefore, high pressure fuel in the high pressure conduit 15 is supplied via the spring chamber 18 and the clearance between the cylinder 12 and the nozzle needle 2 to the fuel accumulating chamber 16. The other structures such as the piezoelectric actuator 5 and the three ways valve 4 according to the second embodiment is same as those according to the first embodiment.

The construction having the sub orifice 62 according to the second embodiment also serves to make the control chamber hydraulic pressure decreasing speed slow so as to secure a slower valve opening of the nozzle needle 2 and to make the control chamber hydraulic pressure increasing speed fast so as to secure a sharp and fast valve closing of the nozzle needle 2.

Further, a volume of the control chamber 3 according to the second embodiment is smaller than that according to the first embodiment since the control chamber 3 of the second embodiment is provided separately from the spring chamber 18 and the control chamber 3 of the first embodiment is provided to work commonly as the spring chamber. Accordingly, a controllability of the second embodiment is superior to that of the first embodiment.

Furthermore, since the main and sub orifices 61 and 62 are formed in the head portion 21 of the nozzle needle 2, the manufacturing of the orifices become easy. Moreover, a fuel injection pressure drop becomes smaller as the spring chamber 18 constitutes a part of the conduit for supplying high pressure fuel to the fuel accumulating chamber 16 and also serves as an accumulator for accumulating high pressure fuel at a vicinity of the injection hole 13.

Third Embodiment

Figure 7:
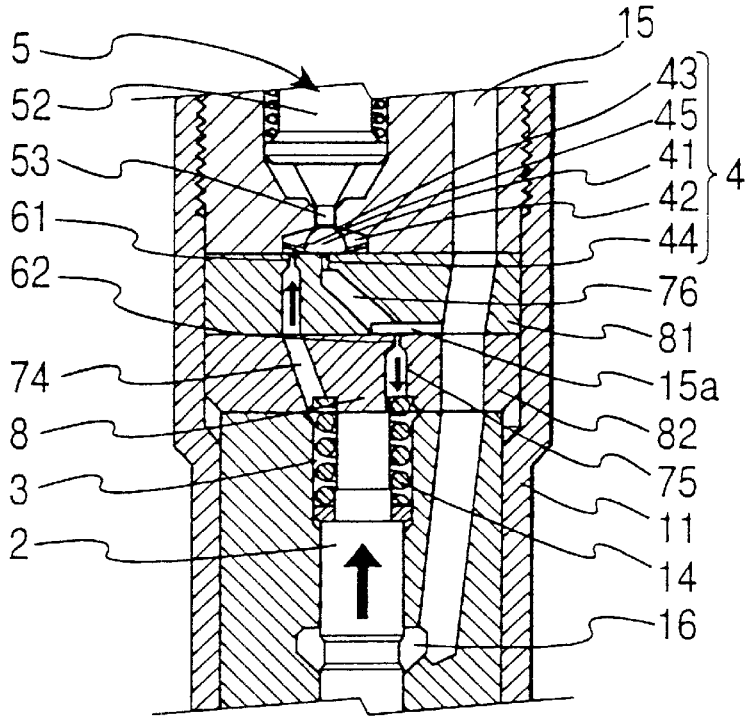
FIG. 7 is across sectional part view of a fuel injection valve according to a third embodiment of the present invention.

A third embodiment of the present invention is described with reference to FIG. 7. The fuel injection valve of the third embodiment is provided with a nozzle stopper 8 for restricting a lift amount of the nozzle needle 2 in order to improve a valve closing response characteristic of the nozzle needle 2. As shown in FIG. 7, conduit-forming members 81 and 82 are provided in the valve housing 11 between the control chamber 3 and the three ways valve 4. The control chamber 3 is communicated via a main orifice conduit 74 (third conduit) provided in the conduit-forming members 81 and 82 to the valve chamber 42 of the three ways valve 4 and, on the other hand, via a sub orifice conduit 75 (fourth conduit) provided in the conduit-forming member 82 to the high pressure conduit 15. The conduit-forming member 81 is further provided with a branch conduit 15*a* branched off from the high pressure conduit 15 and a conduit 76 (second conduit) extending upwardly from the branch conduit 15*a* to the valve chamber 42. The conduit 76 is provided at an end thereof on a side of the valve chamber 42 with the high pressure port 44 of the valve chamber 42.

The main orifice conduit 74 is provided at an end thereof on a side of the three ways valve 4 with a small diameter portion constituting the main orifice 61 and also with the communication port 45 of the valve chamber 42. The sub orifice conduit 75 is connected to the branch conduit 15*a* and is provided at an end opened to the branch conduit 15*a* with a smaller diameter portion constituting the sub orifice 62.

The nozzle lift stopper 8 is formed in a lower end center surface of the conduit-forming member 82 that constitutes an upper end surface of the control chamber 3. The nozzle lift stopper 8 faces an upper end surface of the nozzle needle 2 and restricts the lift amount of the nozzle needle 2 to a predetermined value. FIG. 7 illustrates a state that pressure in the control chamber 3 is low and the nozzle needle 2, in a maximum lift amount, is in contact with a stopper surface (lower end surface) of the nozzle lift stopper 8. A ring shaped recess is provided around an outer circumference of the nozzle lift stopper 8 for holding an upper end of the spring 18. The respective lower ends of the main and sub orifice conduits 74 and 75 are opened to the ring shaped recess. The other constructions of the fuel injection valve of the third embodiment are same as those of the first embodiment.

In a case that the nozzle lift stopper 8 is not provided as in the first embodiment, a longer time for driving the three ways valve 4 causes the nozzle needle 2 to continuously lift due to the hydraulic pressure in the fuel accumulating space 16 even after the injection hole 13 has been completely opened and a predetermined injection rate has been achieved. Accordingly, it takes a longer time for the nozzle needle 2 to start moving downwardly and to close the injection hole 13 after the three ways valve 4 driving is shut off so that a valve closing response characteristic is adversely affected. However, the fuel injection valve having the nozzle lift stopper 8 according to the third embodiment has a good valve closing response characteristic since the lift amount of the nozzle needle 2 is restricted so as to make the upper end of the nozzle needle 2 contact with the stopper surface of the nozzle lift stopper 8 so that the moving amount of the nozzle needle 2 at the valve closing time may be limited.

However, if an area where the nozzle needle 2 is in contact with the nozzle lift stopper 8 is too small at the valve closing time, bearing pressure in the contacted area becomes large so that plastic deformation of the area is likely to take place. On the other hand, if the contacted area is too large to cope with the problem mentioned above, it takes a longer time for high pressure fuel to enter into a clearance between the nozzle needle 2 and the nozzle lift stopper 8 from a circumstance thereof so that starting of valve closing operation by the nozzle needle 2 is delayed. Accordingly, it is very important to determine a largeness of the contacted area to an extent that the bearing pressure in the area does not cause the plastic deformation of the area and the valve closing operation of the nozzle needle 2 is not adversely affected.

Fourth Embodiment

Figure 8:
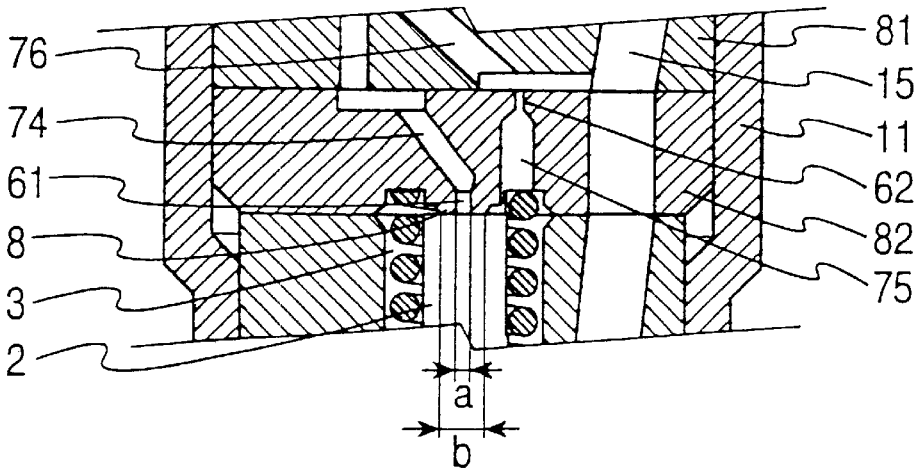
FIG. 8 is a cross sectional partly enlarged view of a fuel injection valve according to a fourth embodiment of the present invention.

A fourth embodiment of the present invention is described with reference to FIG. 8. The fourth embodiment is a modification of the third embodiment in which the largeness of the contacted area may be easily determined. According to the fourth embodiment, the main orifice conduit 74 for communicating the control chamber 3 to the three ways valve 4 is formed in the nozzle lift stopper 8 so as to be opened to the control chamber 3 at a center lower end of the nozzle lift stopper 8 (stopper surface) not at the ring shaped recess around the nozzle lift stopper 8. Further, the main orifice 61 is formed in the main orifice conduit 74 at an opening end to the control chamber 3 not at the opening end to the three ways valve 4. Furthermore, the nozzle lift stopper 8 is formed in a taper shape in such a manner that an outer diameter of the nozzle lift stopper 8 becomes smaller downwardly. The outer diameter b of the nozzle lift stopper 8 at the lower end thereof constituting the stopper surface is smaller that a diameter of the nozzle needle 2 at the upper end thereof for contacting with the stopper surface.

At the valve opening time, when the upper end of the nozzle needle 2 comes in contact with the nozzle lift stopper 8, the main orifice conduit 74, which is opened to the stopper surface of the nozzle lift stopper. 8, is closed. Then, at the valve closing time, when high pressure fuel is flown into the main orifice conduit 74 via the three ways valve 4 from the high pressure conduit 15, the hydraulic pressure is applied to a center upper end of the nozzle needle that faces the main orifice 61 and corresponds to a diameter (a) of the main orifice. Further, hydraulic pressure of fuel flown in the sub orifice conduit 75 via the branch conduit 15*a* from the high pressure conduit 15 is applied to the ring shaped recess outside the diameter (b) of the stopper surface that faces an upper end circumferential surface of the nozzle needle 2. Accordingly, both hydraulic pressure mentioned above serve to easily move the nozzle needle 2 for the valve closing operation.

In the fourth embodiment, it is very important to determine largeness of the area of the stopper surface of the nozzle lift stopper 8 and largeness of the area of the upper end surface of the nozzle needle 2. In the third embodiment, when the nozzle needle 2 comes in contact with the nozzle lift stopper 8, pressure in the control chamber 3 becomes finally a stable pressure Ps (lower than common rail pressure Pc), which is decided by the respective diameters of the main and sub orifices 61 and 62 since the main and sub orifices 61 and 62 are communicated with each other. At this time, the stable pressure Ps is applied to the upper end surface of the nozzle needle 2 and is effective to reduce the bearing pressure therein.

On the other hand, in the fourth embodiment, when the nozzle needle 2 achieves the maximum lift amount, high pressure (common rail pressure Pc) is applied via the sub orifice conduit 75 to the upper end outer circumferential surface of the nozzle needle 2 and low pressure (drain pressure) is applied via the main orifice conduit 74 to the upper end center surface of the nozzle needle 2 since the communication of the main orifice conduit 74 to the control chamber 3 is interrupted.

Therefore, to reduce a force acting on the nozzle lift stopper 8, it is preferable to enlarge an area of the upper end outer circumferential surface of the nozzle needle 2 to which high pressure is applied. To secure lower bearing pressure in the nozzle lift stopper 8 compared with that of the third embodiment, a ratio ($S_{out}$/Sa) of the area $S_{out}$ of the upper end outer circumferential surface of the nozzle needle 2 to the area Sa of the upper end whole surface thereof is, preferably, larger than Ps/Pc. According to the fourth embodiment, as the main orifice 61 whose diameter is smaller is provided in the main orifice conduit 74 at the opening end to the control chamber 3, it is relatively easy to make the diameter of the nozzle lift stopper 8 small, that is, to make the stopper surface small, so that the bearing pressure therein may be easily reduced.

It is preferable for reducing the bearing pressure that the area where the nozzle needle 2 is in contact with the nozzle lift stopper 8 (an area of a ring shaped portion defined by the outer diameter (b) of the stopper surface and a diameter (a) of the main orifice 61) is as large as possible. On the other hand, to start the valve closing operation of the nozzle needle when the driving of the three ways valve 4 is shut off, it is preferable that the area of the nozzle needle in contact with the stopper surface is as small as possible. In consideration of the matters mentioned above, the structural shape and largeness of the nozzle needle 2 or the nozzle lift stopper 8 may be decided.

Further, according to the third embodiment, as the control chamber 3 is always communicated via the sub orifice conduit 75 to the high pressure conduit 15, high pressure fuel flows from the sub orifice conduit 74 via the control chamber 3, the main orifice conduit 74 to the valve chamber 42 at the valve opening time (when the low pressure port 43 is opened). However, according to the fourth embodiment, as the main orifice conduit 74 is closed by the upper end surface of the nozzle needle 2, high pressure fuel does not flows from a side of the sub orifice 62 to a side of the main orifice 61.

Furthermore, though the main orifice 61 is located at the opening end to the control chamber 3 according to the fourth embodiment, the main orifice 61 may be provided at any place of the main orifice conduit 74, unless the diameter of the main orifice conduit 74 is smaller than the diameter of the main orifice 61 and unless the injection characteristic (decided by the main and sub orifices 61 and 62) is adversely affected.

In the third and fourth embodiments, a plurality of fluid-forming members 81 and 82 are provided between the control chamber 3 and the three ways valve 4. This is due to the following reason. It is important not to intersect at acute angles the conduits through which high pressure fuel is supplied from the high pressure conduit 15 to the control chamber 3 or to the high pressure port 44. For this purpose, the branch conduit 15*a* extending perpendicularly to the high pressure conduit 15 is provided at the boundary portion of the conduit-forming members 81 and 82 and, therefore, the sub orifice conduit 75 and the conduit 76 can be respectively connected to the branch conduit 15*a* in order not to intersect at acute angles so that possible crack on the intersecting portions due to high pressure may be prevented.

Fifth Embodiment

A fifth embodiment of the present invention is described with reference to FIGS. 9A to 9C. According to the third and fourth embodiments, the plurality of conduit-forming members 81 and 82 are necessary. Therefore, to reduce a number of parts and components and to save a manufacturing cost, the conduit-forming member according to the fifth embodiment is a single member having the same effect as the third and fourth embodiments.

Figure 9A:
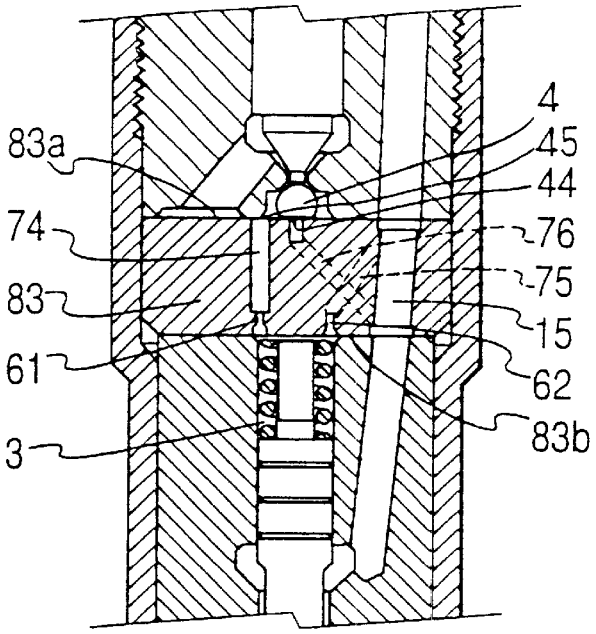
FIG. 9A is a cross sectional part view of a fuel injection valve according to a fifth embodiment of the present invention.
Figure 9B:
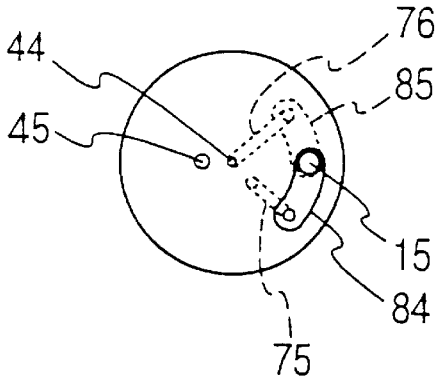
FIG. 9B is a plan view of a conduit-forming member of the fuel injection valve of FIG. 9A.
Figure 9C:
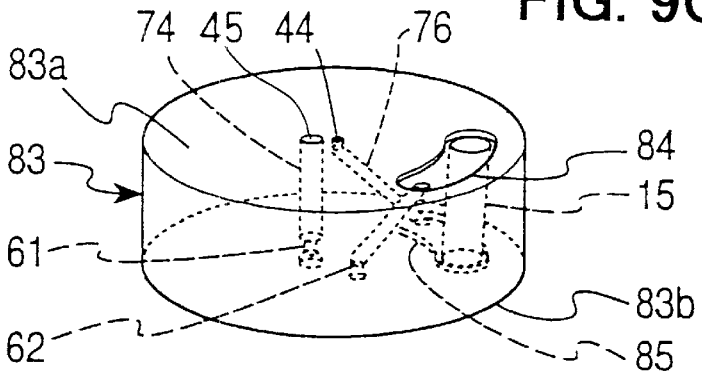
FIG. 9C is a perspective view of the conduit-forming member of FIG. 9B.

As shown in FIG. 9A, a basic structure of a fuel injection valve according to the fifth embodiment is same as that of the third embodiment. It is only different that, instead of the plurality of the conduit-forming members 81 and 82, a column- block shaped conduit-forming member 83 is provided, as shown in FIGS. 9B and 9C. An upper end surface 83*a* of the conduit-forming member 83 constitutes a chamber wall of the valve chamber 42 of the three ways valve 4 and a lower end surface 83*b* constitutes a chamber wall of the control chamber 3. The main orifice conduit 74 for communicating the valve chamber 42 to the control chamber 3 is formed in the conduit-forming member 83 so as to penetrate in up and down directions along a portion slightly offset from a center portion thereof. The main orifice conduit 74 is provided at a lower end thereof with the main orifice 61 whose diameter is smaller. The conduit-forming member 83 is provided at a periphery thereof with a larger diameter conduit penetrating in up and down directions for constituting a part of the high pressure conduit 15.

A short arc shaped groove 84 is formed at a periphery of an upper end surface 83*a* of the conduit-forming member 83. The high pressure conduit 15 is opened to an end side of the groove 84 and the sub orifice conduit 75 is opened to an another end side thereof. The sub orifice conduit 75 extends obliquely and downwardly toward a center portion of a lower end surface 83*b* of the fluid-forming member 83 to communicate to the control chamber 3. The sub orifice 62 whose diameter is smaller is provided at a lower opening end of the sub orifice conduit 75.

Further, a short arc shaped groove 85 is formed at a periphery of the lower end surface 83*b* of the conduit-forming member 83. The high pressure conduit 15 is opened to an end side of the groove 85 and the conduit 76 is opened to an another end side thereof. The conduit 76 extends obliquely and upwardly toward a center portion of the upper end surface 83*a* of the fluid-forming member 83 to communicate to the high pressure port 44 that is opened to the upper end surface 83*a* of the fluid-forming member 83.

The grooves 84 and 85 are conduits communicating the sub orifice conduit 75 to the high pressure conduit 15 and communicating the conduit 76 to the high pressure conduit 15, respectively. The grooves 84 and 85 extend in opposite directions to each other from a position of the high pressure conduit 15 so that the sub orifice conduit 76 and the conduit 76 may not come close to each other. As the grooves 84 and 85 are formed at peripheries of opposite ends of the fluid-forming member 83, the grooves 84 and 85 do not interfere with formations of the control chamber 3 and the valve chamber 42 at center portions thereof.

According to the construction mentioned above, as the sub orifice conduit 75 and the conduit 76 are connected via the grooves 84 and 85 to the high pressure conduit 15, respectively, each of the grooves 84 and 85 may intersect at a near right angle or at an obtuse angle with the sub orifice conduit 75, the conduit 76 or the high pressure conduit 15. If the sub orifice conduit 75 and the conduit 76 be connected directly to the high pressure conduit 15 without providing the grooves 84 and 85, respectively, some of the connections have acute angle intersections that are weak for bearing high pressure. However, according to the construction mentioned above, respective connections of the groove 84 and 85 have near right angle intersections with respect to the high pressure conduit 15 and have obtuse angle intersections with respect to the sub orifice conduit 75 and the conduit 76. Accordingly, the structure is strong in bearing high pressure and, further, is manufactured at less cost since the fluid-forming member 83 is a single block element.

Sixth Embodiment

Figure 10:
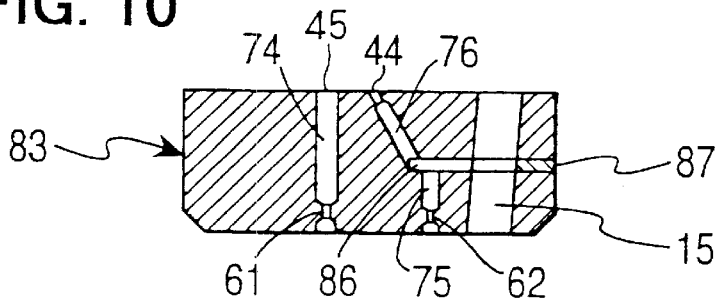
FIG. 10 is across sectional part view of a fuel injection valve according to a sixth embodiment of the present invention.

A sixth embodiment of the present embodiment is described with reference to FIG. 10. As shown in FIG. 10, the conduit-forming member 83 is provided inside with a hole 86 as a conduit instead of the grooves 84 and 85 provided at the upper and lower end surfaces thereof according to the fifth embodiment. The hole 86 is formed to extend horizontally from a middle portion in up and down directions of an outer circumference surface of the conduit-forming member 83 toward a center of the conduit-forming member 83. The conduit 76 is formed to extend obliquely and upwardly from a center side end of the hole 86. The sub orifice conduit 75 is formed to extend downwardly from the center side end of the hole 86. An outer circumferential end of the hole 86 is filled with a tap 87. According to the structure mentioned, the respective connections of the conduits may be formed without making the acute angle intersections and the conduit-forming member may be a single element.

What is claimed is:

1. A fuel injection valve to be connectable to a hydraulic pressure passage and a drain passage, comprising:

a valve housing having at least an injection hole;

a nozzle needle slidably movable in the valve housing for opening and closing the injection hole;

a control chamber for urging the nozzle needle in a direction of closing the injection hole when hydraulic pressure is applied thereto and making the nozzle needle start lifting when hydraulic pressure reaches a minimum valve opening pressure;

a low pressure conduit to be connected to the drain passage;

a high pressure conduit to be connected to the high pressure passage;

a three ways valve having a valve chamber, first, second and third ports provided in the valve chamber and a valve body movable in the valve chamber;

driving means for driving the valve body so as to selectively open and close the first and second ports;

a first conduit for communicating the first port to the low pressure conduit;

a second conduit for communicating the second port to the high pressure conduit;

a third conduit having a main orifice for communicating the third port to the control chamber;

a fourth conduit having a sub orifice for communicating the control chamber to the high pressure conduit so that high pressure may be applied to the control chamber, wherein the control chamber may be communicated to the low pressure conduit via the third conduit, the valve chamber and the first conduit, when the valve body opens the first port and closes the second port, and be communicated to the high pressure conduit via the third conduit, the valve chamber and the second conduit, when the valve body closes the first port and opens the second port.

2. A fuel injection valve according to claim 1, wherein a ratio of a diameter of the sub orifice to that of the main orifice falls within a range from 0.5 to 1.0 when the minimum valve opening pressure is set to not larger than 20 Mpa.

3. A fuel injection valve according to claim 1, wherein a ratio of a diameter of the sub orifice to that of the main orifice falls within a range from 0.6 to 1.2 when the minimum valve opening pressure is set to not larger than 30 Mpa.

4. A fuel injection valve according to claim 1, further comprising:

a spring chamber communicated to the high pressure conduit so as to constitute a part of the high pressure conduit; and a spring for urging the nozzle needle in a direction of closing the injection hole is housed in the spring chamber, wherein the nozzle needle has a head, the head of the nozzle needle is housed in the spring chamber, the control chamber is formed inside the nozzle needle, the third conduit having the main orifice extends from the control chamber to the second port through the inside of the nozzle needle and a space of the spring chamber but without communicating to the spring chamber, and the fourth conduit having the sub orifice extends from the control chamber to the spring chamber through the inside of the nozzle needle.

5. A fuel injection valve according to claim 1, wherein an upper end of the nozzle needle protrudes into the control chamber and a part of a wall of the control chamber facing the upper end of the nozzle needle constitutes a stopper portion with which the upper end of the nozzle needle may come in contact and by which a movement of the nozzle needle may be stopped for restricting a lift amount thereof.

6. A fuel injection valve according to claim 5, wherein the third conduit having the main orifice is opened to a surface of the stopper portion facing the control chamber so that the third conduit may be closed by the nozzle needle when the upper end surface of the nozzle needle is in contact with the stopper.

7. A fuel injection valve according to claim 6, wherein the main orifice is formed in the third conduit at an opening end to the control chamber.

8. A fuel injection valve according to claim 1, wherein at least the second and fourth conduits are formed in a block shaped conduit-forming member disposed between the valve chamber and the control chamber whose one end surface constitutes a part of a wall of the valve chamber and whose another end surface constitutes a part of a wall of the control chamber, further, wherein the conduit-forming member is provided with the high pressure conduit penetrating from the one end surface thereof to the another end surface thereof, a branch conduit extending from the high pressure conduit, the second conduit extending from the branch conduit to the valve chamber and the fourth conduit having the sub orifice extending from the branch conduit to the control chamber, furthermore, wherein respective connections of the branch conduit to the high pressure conduit, to the second conduit and to the fourth conduit are made at an angle more than a near right angle.

9. A fuel injection valve according to claim 8, wherein the branch conduit is constituted by at least one of a hole extending horizontally from the high pressure conduit toward an inside of the conduit-forming member and a groove extending from the high pressure conduit on at least one of end surfaces of the conduit-forming member.

10. A fuel injection valve according to claim 9, wherein the groove is provided on each of opposite end surfaces of the conduit-forming member, the second conduit is connected to one of the grooves and the fourth conduit having the sub orifice is connected to the other of the grooves, and the grooves extend in opposite directions from the high pressure conduit so as to put the second and fourth conduits therebetween.

* * * * *